US008393854B2

(12) United States Patent
Stones et al.

(10) Patent No.: US 8,393,854 B2
(45) Date of Patent: Mar. 12, 2013

(54) VACUUM PUMP

(75) Inventors: Ian David Stones, Burgess Hill (GB); David John Goodwin, Southgate (GB)

(73) Assignee: Edwards Limited, Crawley, West Sussex (GB)

( * ) Notice: Subject to any disclaimer, the term of this patent is extended or adjusted under 35 U.S.C. 154(b) by 797 days.

(21) Appl. No.: 10/572,889

(22) PCT Filed: Sep. 23, 2004

(86) PCT No.: PCT/GB2004/004114
§ 371 (c)(1),
(2), (4) Date: Mar. 20, 2006

(87) PCT Pub. No.: WO2005/033521
PCT Pub. Date: Apr. 14, 2005

(65) Prior Publication Data

US 2007/0031263 A1 Feb. 8, 2007

(30) Foreign Application Priority Data

Sep. 30, 2003 (GB) ..... 0322883.0

(51) Int. Cl.
*F01D 3/02* (2006.01)

(52) U.S. Cl. ..... 415/90

(58) Field of Classification Search ..... 415/72, 415/74, 90, 199.5; 416/176, 177
See application file for complete search history.

(56) References Cited

U.S. PATENT DOCUMENTS 4,732,529 A 3/1988 Narita et al.
4,797,068 A 1/1989 Hayakawa et al.
4,826,393 A * 5/1989 Miki ..... 415/72
4,826,394 A 5/1989 Lotz
4,978,276 A * 12/1990 Kabelitz et al. ..... 415/55.3
5,052,887 A * 10/1991 Novikov et al. ..... 415/90
5,116,196 A * 5/1992 Baret et al. ..... 415/89
5,553,998 A * 9/1996 Muhlhoff et al. ..... 415/90
5,707,213 A * 1/1998 Conrad ..... 417/53
5,733,104 A 3/1998 Conrad et al.
6,030,189 A * 2/2000 Bohm et al. ..... 417/423.4
6,106,223 A * 8/2000 Leyshon ..... 415/90
6,135,709 A * 10/2000 Stones ..... 415/90
6,193,461 B1 * 2/2001 Hablanian ..... 415/90
6,394,747 B1 * 5/2002 Hablanian ..... 415/55.1

(Continued)

FOREIGN PATENT DOCUMENTS

EP 0 256 739 B1 5/1991
EP 0 919 726 A1 6/1999

(Continued)

OTHER PUBLICATIONS

United Kingdom Search Report of Application No. GB 0322883.0; Date of search: Mar. 18, 2004.

(Continued)

*Primary Examiner* — Edward Look
*Assistant Examiner* — Aaron R Eastman

(57) ABSTRACT

A vacuum pump comprises a first pumping section (106), and, downstream therefrom, a second pumping section (108), The pump comprises a first pump inlet (120) through which fluid can enter the pump and pass through both the first and second pumping sections towards a pump outlet, and a second pump inlet (122) through which fluid can enter the pump and pass through only the second pumping section towards the outlet. The second pumping section (108) comprises an externally threaded rotor (109).

45 Claims, 8 Drawing Sheets

U.S. PATENT DOCUMENTS

| | | | | |
|---|---|---|---|---|
| 6,435,811 | B1 | 8/2002 | Beyer et al. | |
| 6,454,524 | B1 * | 9/2002 | Okada et al. | 415/90 |
| 6,457,954 | B1 * | 10/2002 | Adamietz et al. | 417/423.4 |
| 6,607,365 | B1 * | 8/2003 | Kabasawa et al. | 417/295 |
| 6,709,228 | B2 * | 3/2004 | Stuart | 415/90 |
| 2002/0025249 | A1 | 2/2002 | Iwane | |
| 2003/0086784 | A1 * | 5/2003 | Stuart | 415/90 |
| 2004/0081560 | A1 * | 4/2004 | Blumenthal et al. | 417/32 |
| 2004/0096311 | A1 * | 5/2004 | Englander et al. | 415/90 |
| 2007/0020116 | A1 * | 1/2007 | Stones | 417/201 |
| 2007/0081889 | A1 * | 4/2007 | Englander | 415/90 |
| 2007/0116555 | A1 * | 5/2007 | Stones et al. | 415/90 |
| 2008/0063541 | A1 * | 3/2008 | Stones | 417/250 |
| 2008/0138219 | A1 * | 6/2008 | Stones et al. | 417/423.4 |
| 2008/0145205 | A1 * | 6/2008 | Stones | 415/143 |
| 2008/0193303 | A1 * | 8/2008 | Stones | 417/251 |

FOREIGN PATENT DOCUMENTS

| | | | |
|---|---|---|---|
| EP | 1 302 667 | A1 | 4/2003 |
| GB | 2 360 066 | A | 9/2001 |
| JP | 2002349464 | A | 12/2002 |

OTHER PUBLICATIONS

United Kingdom Search Report of Application No. GB 0322883.0; Date of search: Jun. 9, 2004.

PCT International Search Report of International Application No. PCT/GB2004/004114; Date of mailing of International Search Report: Jan. 14, 2005.

PCT Written Opinion of the International Search Authority of International Application No. PCT/GB2004/004114; Date of mailing: Jan. 14, 2005.

* cited by examiner

VACUUM PUMP

FIELD OF THE INVENTION

This invention relates to a vacuum pump and in particular a compound vacuum pump with multiple ports suitable for differential pumping of multiple chambers.

BACKGROUND OF THE INVENTION

In a differentially pumped mass spectrometer system a sample and carrier gas are introduced to a mass analyser for analysis. One such example is given in FIG. 1. With reference to FIG. 1, in such a system there exists a high vacuum chamber 10 immediately following first and second evacuated interface chambers 12, 14. The first interface chamber 12 is the highest-pressure chamber in the evacuated spectrometer system and may contain an orifice or capillary through which ions are drawn from the ion source into the first interface chamber 12. The second, interface chamber 14 may include ion optics for guiding ions from the first interface chamber 12 into the high vacuum chamber 10. In this example, in use, the first interface chamber 12 is at a pressure of around 1 mbar, the second interface chamber 14 is at a pressure of around $10^{-3}$ mbar, and the high vacuum chamber 10 is at a pressure of around $10^{-5}$ mbar.

The high vacuum chamber 10 and second interface chamber 14 can be evacuated by means of a compound vacuum pump 16. In this example, the vacuum pump has a first pumping section 18 and a second pumping section 20 each in the form of a set of turbo-molecular stages, and a third pumping section in the form of a Holweck drag mechanism 22; an alternative form of drag mechanism, such as a Siegbahn or Gaede mechanism, could be used instead. Each set of turbo-molecular stages comprises a number (three shown in FIG. 1, although any suitable number could be provided) of rotor 19*a*, 21*a* and stator 19*b*, 21*b* blade pairs of known angled construction. The Holweck mechanism 22 includes a number (two shown in FIG. 1 although any suitable number could be provided) of rotating cylinders 23*a* and corresponding annular stators 23*b* and helical channels in a manner known per se.

In this example, a first pump inlet 24 is connected to the high vacuum chamber 10, and fluid pumped through the inlet 24 passes through both sets of turbo-molecular stages in sequence and the Holweck mechanism 22 and exits the pump via outlet 30. A second pump inlet 26 is connected to the second interface chamber 14, and fluid pumped through the inlet 26 passes through one set of turbo-molecular stages and the Holweck mechanism 22 and exits the pump via outlet 30. In this example, the first interface chamber 12 may be connected to a backing pump (not shown), which may also pump fluid from the outlet 30 of the compound vacuum pump 16. As fluid entering each pump inlet passes through a respective different number of stages before exiting from the pump, the pump 16 is able to provide the required vacuum levels in the chambers 10, 14.

In order to increase system performance, it is desirable to increase the mass flow rate of the sample and gas. For the pump illustrated in FIG. 1, this could be achieved without affecting system pressures by increasing the capacity of the compound vacuum pump 16 by increasing the diameter of the rotors 21*a* and stators 21*b* of the turbo-molecular stages of the second pumping section 20. For example, in order to double the capacity of the pump 16, the area of the rotors 21*a* and stators 21*b* would be required to double in size. In addition to increasing the overall size of the pump 16, and thus the overall size of the mass spectrometer system, the pump 16 would become more difficult to drive in view of the increased mass acting on the drive shaft 32 due to the larger rotors and stators of the second pumping section 20. Alternatively, if the system flow rate is increased and the pump is not increased in capacity, the pressure at the inlet to the turbomolecular stages, 20, may exceed operational limits. It is a known consequence of this type of turbomolecular technology that operation above approximately $10^{-3}$ mbar may cause excessive heat generation and severe performance loss and may even be detrimental to the pump reliability.

It is an aim of at least the preferred embodiments of the present invention to provide a differential pumping, multi port, compound vacuum pump, which can enable the mass flow rate in an evacuated system to be increased specifically where required without significantly increasing the size of the pump.

BRIEF SUMMARY OF THE INVENTION

In a first aspect, the present invention provides a vacuum pump comprising a first pumping section, a second pumping section downstream from the first pumping section, a third pumping section downstream from the second pumping section, a first pump inlet through which fluid can enter the pump and pass through each of the pumping sections towards a pump outlet, and a second pump inlet through which fluid can enter the pump and pass through only the second and the third pumping sections towards the outlet, wherein the third pumping section comprises a helical groove formed in a stator thereof, and at least one of the first and second pumping sections comprises a helical groove formed in a rotor thereof.

Thus, the second, turbo-molecular pumping section 20, for example, of the known pump described with reference to FIG. 1 can be effectively replaced by a pumping section having an externally threaded, or helical, rotor. In such an arrangement, the inlet of the helix will behave in use like a rotor of a turbo-molecular stage, and thus provide a pumping action through both axial and radial interactions. In comparison, a Holweck mechanism with a static thread, such as that indicated at 22 in FIG. 1, pumps fluid by nominally radial interactions between the thread and cylinder. Beyond a certain radial depth of thread, this mechanism becomes less efficient due to the reducing number of radial interactions, and it is for this reason that the typical capacity of a "static" Holweck mechanism is limited to less than that of an equivalent diameter turbo-molecular stage, which pumps by nominally axial interactions and has greater radial blade depths. By providing an externally threaded rotor, the inlet of the thread of the externally threaded rotor can be made much deeper radially than the helical groove in a static Holweck mechanism, resulting in a significantly higher pumping capacity. By appropriate design, the capacity of an externally threaded, deep grooved helical rotor can be comparable to that of an equivalent diameter turbomolecular stage when operating at low inlet pressures, for example below $10^{-3}$ mbar. The advantage of the use of such a deep groove helical rotor in place of a turbomolecular stage is that it can offer a higher capacity at higher inlet pressures (above $10^{-3}$ mbar) with lower levels of power consumption/heat generation—a limiting factor of the operational window of turbomolecular pumps. By utilising a deep groove helical rotor and raising the inlet pressure above that which would be ideal for a turbomolecular pump, more flow can be pumped without requiring an increase in effective pumping capacity, thus meeting the requirements of increased evacuated system performance without increasing the size of the pump envelope.

Minimising the increase in pump size/length whilst increasing the system performance where required can make the pump particularly suitable for use as a compound pump for use in differentially pumping multiple chambers of a bench-top mass spectrometer system requiring a greater mass flow rate at, for example, the middle chamber to increase the sample flow rate into the analyser with a minimal or no increase in pump size.

Furthermore, offering static surfaces adjacent to the outlet of the helical rotor stage, by providing a third pumping section having a helical groove formed in a stator thereof, can further optimise pump performance.

As the molecules transfer from the inlet side of the rotor towards the outlet side, the pumping action is similar to that of a static Holweck mechanism, and is due to radial interactions between rotating and stationary elements. Therefore, the helical rotor preferably has a tapering thread depth from inlet to outlet (preferably deeper at the inlet side than at the outlet side). Furthermore, the helical rotor preferably has a different helix angle at the inlet side than at the outlet side; both the thread depth and helix angle are preferably reduced smoothly along the axial length of the pumping section from the inlet side towards the outlet side.

In a preferred arrangement, the first pumping section comprises at least one turbo-molecular stage, preferably at least three turbo-molecular stages. The first and second pumping sections may be of a different size/diameter. This can offer selective pumping performance.

Thus, preferably the helical rotor is located downstream from said at least one turbo-molecular stage. To ensure that fluid enters the helical rotor with maximum relative velocity to the helix blades, and thereby optimise pumping performance, the turbo-molecular stage is preferably arranged such that the molecules of fluid entering the helical rotor have been emitted from the surface of a stator of the turbomolecular stage by placing a stator stage as the final stage of the turbomolecular section adjacent the inlet side of the helical rotor.

In addition to the helical rotor, the second pumping section may further comprise at least one turbomolecular pumping stage downstream from the helical rotor. By positioning the second inlet such that it extends partially about the helical rotor, as opposed to being axially spaced therefrom, the capture rate of molecules from the chamber connected to the second inlet can be improved, in particular for relatively light gases, thereby reducing the pressure in the chamber evacuated through the second inlet. Therefore, in a second aspect the present invention provides a vacuum pump comprising a first pumping section and, downstream therefrom, a second pumping section, a first pump inlet through which fluid can enter the pump and pass through both the first pumping section and the second pumping section towards a pump outlet, and a second pump inlet through which fluid can enter the pump and pass through, of said sections, only the second pumping section towards the outlet, wherein one of the first and second pumping sections comprises an externally threaded rotor and one of the first and second pump inlets extends at least partially about the externally threaded rotor.

The invention also provides a differentially pumped vacuum system comprising two chambers and a pump as aforementioned for evacuating each of the chambers. One of the pumping sections arranged to pump fluid from a chamber in which a pressure above $10^{-3}$ mbar, more preferably above $5\times10^{-3}$ mbar, is to be generated preferably comprises an externally threaded rotor.

BRIEF DESCRIPTION OF THE DRAWINGS

Preferred features of the present invention will now be described, by way of example only, with reference to the accompanying drawings, in which:

FIG. 4(*b*) is a plan view of the pump of FIG. 4(*a*);

FIG. 6(*b*) is a plan view of the pump of FIG. 6(*a*).

DETAILED DESCRIPTION OF THE INVENTION

Figure 1:
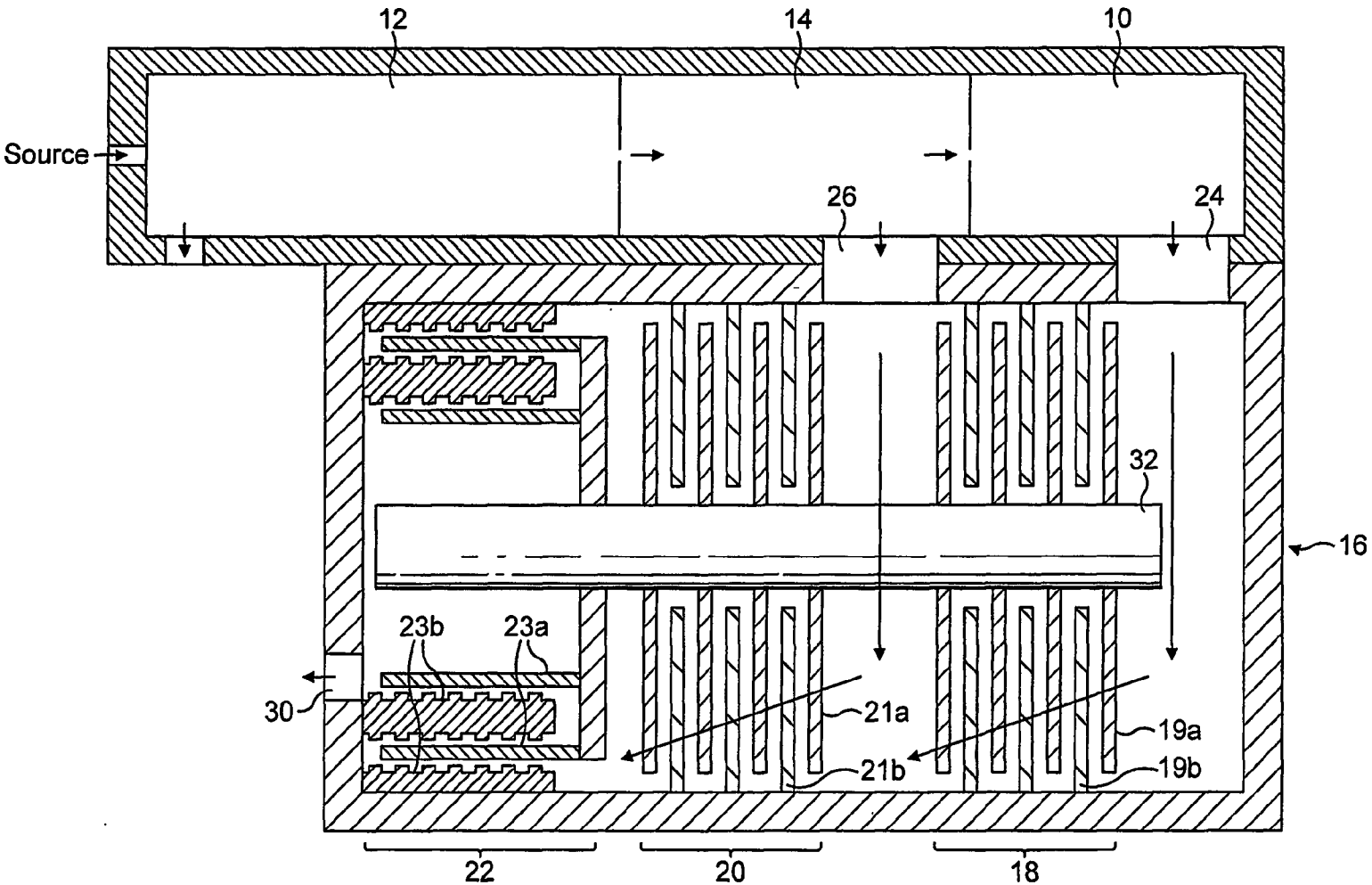
FIG. 1 (PRIOR ART)
FIG. 1 is a simplified cross-section through a known multi port vacuum pump suitable for evacuating a differentially pumped, mass spectrometer system.
Figure 2:
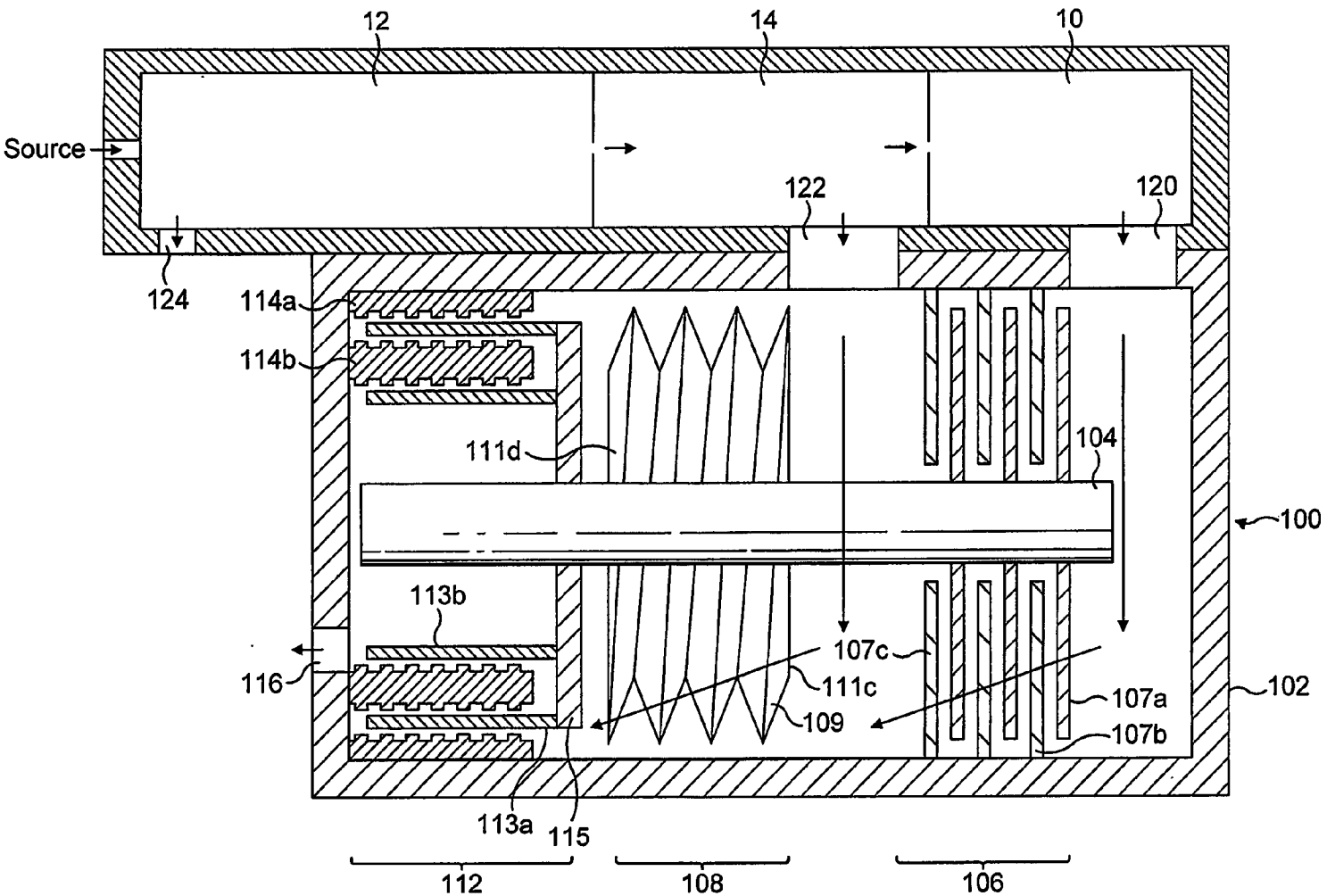
FIG. 2 is a simplified cross-section through a first embodiment of a multi port vacuum pump suitable for evacuating the differentially pumped mass spectrometer system of FIG. 1.

With reference to FIG. 2, a first embodiment of a vacuum pump 100 suitable for evacuating at the least the high vacuum chamber 10 and intermediate chamber 14 of the differentially pumped mass spectrometer system described above with reference to FIG. 1 comprises a multi-component body 102 within which is mounted a shaft 104. Rotation of the shaft is effected by a motor (not shown), for example, a brushless dc motor, positioned about the shaft 104. The shaft 104 is mounted on opposite bearings (not shown). For example, the drive shaft 104 may be supported by a hybrid permanent magnet bearing and oil lubricated bearing system.

The pump includes three pumping sections 106, 108 and 112. The first pumping section 106 comprises a set of turbomolecular stages. In the embodiment shown in FIG. 2, the set of turbo-molecular stages 106 comprises three rotor blades and three stator blades of known angled construction. A rotor blade is indicated at 107*a* and a stator blade is indicated at 107*b*. In this example, the rotor blades 107*a* are mounted on the drive shaft 104.

Figure 3:
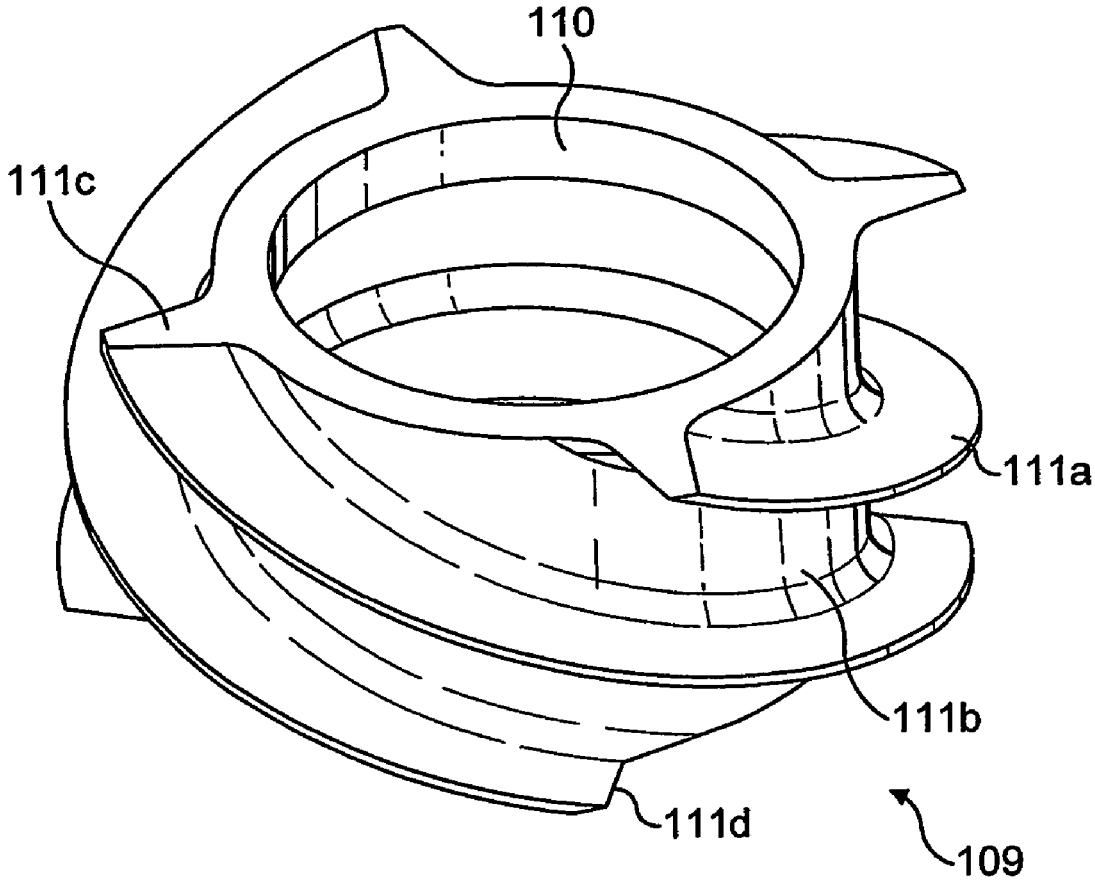
FIG. 3 illustrates an externally threaded rotor of the pump of FIG. 2.

The second pumping section 108 comprises an externally threaded rotor 109, as shown in more detail in FIG. 3. The rotor 109 comprises a bore 110 through which passes the drive shaft 104, and an external thread 111*a* defining a helical groove 111*b*. The depth of the thread 111*a*, and thus the depth of the groove 111*b*, can be designed to taper from the inlet side 111*c* of the rotor 109 towards the outlet side 111*d*. In this embodiment, the thread 111*a* is deeper at the inlet side than at the outlet side, although this is not essential. The helix angle, namely the angle of inclination of the thread to a plane perpendicular to the axis of the shaft 104, of the rotor can also vary from the inlet side to the outlet side; in this embodiment, the helix angle is shallower at the outlet side than at the inlet side, although again this is not essential.

As shown in FIG. 2, downstream of the first and second pumping sections is a third pumping section 112 in the form of a Holweck or other type of drag mechanism. In this embodiment, the Holweck mechanism comprises two rotating cylinders 113*a*, 113*b* and corresponding annular stators 114*a*, 114*b* having helical channels formed therein in a manner known per se. The rotating cylinders 113*a*, 113*b* are preferably formed from a carbon fibre material, and are mounted on a disc 115, which is located on the drive shaft 104. In this example, the disc 115 is also mounted on the drive shaft 104. Downstream of the Holweck mechanism 112 is a pump outlet 116.

As an alternative to individually mounting the rotary elements 107*a*, 109 and 115 on the drive shaft 104, one or more these elements may be located on, preferably integral with, a common impeller mounted on the drive shaft 104, with the carbon fibre rotating cylinders 113*a*, 113*b* of the Holweck mechanism 112 being mounted on the rotating disc 115 following machining of these integral rotary elements.

As illustrated in FIG. 2, the pump 100 has two inlets; although only two inlets are used in this embodiment, the pump may have three or more inlets, which can be selectively opened and closed and can, for example, make the use of internal baffles to guide different flow streams to particular portions of a mechanism. The first, low fluid pressure inlet 120 is located upstream of all of the pumping sections. The second, high fluid pressure inlet 122 is located interstage the first pumping section 106 and the second pumping section 108.

In use, each inlet is connected to a respective chamber of the differentially pumped mass spectrometer system. Fluid passing through the first inlet 120 from the low pressure chamber 10 passes through each of the pumping sections 106, 108, 112 and exits the pump 100 via pump outlet 116. To ensure that fluid enters the helical rotor 109 of the second pumping stage 108 with maximum relative velocity to the helix blades (threads), and thereby optimise pumping performance, in this embodiment the first pumping section 106 is preferably arranged such that the molecules of fluid entering the helical rotor 109 have been emitted from the surface of the final stator 107*c* of that section 106, and the subsequent stage of the Holweck mechanism 112 is also preferably stationary to offer static surfaces at the outlet side 111*d* of the rotor 109.

Fluid passing through the second inlet 122 from the middle pressure chamber 14 enters the pump 100 and passes through pumping sections 108, 112 only and exits the pump via outlet 116. Fluid passing through a third inlet 124 from the high pressure chamber 12 may be pumped by a backing pump (not shown) which also backs the pump 100 via outlet 116.

In this embodiment, in use, the first interface chamber 12 is at a pressure of around 1 mbar, the second interface chamber 14 is at a pressure of around $10^{-2}$-$10^{-3}$ mbar, and the high vacuum chamber 10 is at a pressure of around $10^{-5}$ mbar. Thus, in comparison to the example illustrated in FIG. 1, the pressure in the second interface chamber 14 can be increased in the embodiment shown in FIG. 2. By increasing the pressure from around $10^{-3}$ mbar to around $10^{-2}$ mbar, the requirements on pumping speed are reduced by the ratio of the old to the new pressure for a fixed flow. Therefore, for example, if the pressure is raised ten-fold, and the flow rate is doubled, the pumping speed at this new pressure can be reduced 5-fold, although in use it would clearly be beneficial to maintain as high a pumping speed as possible to maximise the flow rate from the second interface chamber 14. A turbo-molecular pumping section such as that indicated at 20 in FIG. 1 would not be as effective as the pumping section 108 in FIG. 2 at maintaining a pressure of around $10^{-2}$ mbar in the second interface chamber 14, and would in use consume more power, generating more heat than pumping section 108 and potentially have less performance due to operating further outside its effective performance range.

Thus, a particular advantage of the embodiment described above is that the mass flow rate of fluid entering the pump from the middle chamber 14 can be at least doubled in comparison to the known arrangement shown in FIG. 1 without any increase in the size of the pump. In view of this, the flow rate of the sample entering the high vacuum chamber 10 from the middle chamber can also be increased, increasing the performance of the differentially pumped mass spectrometer system.

Figure 4A:
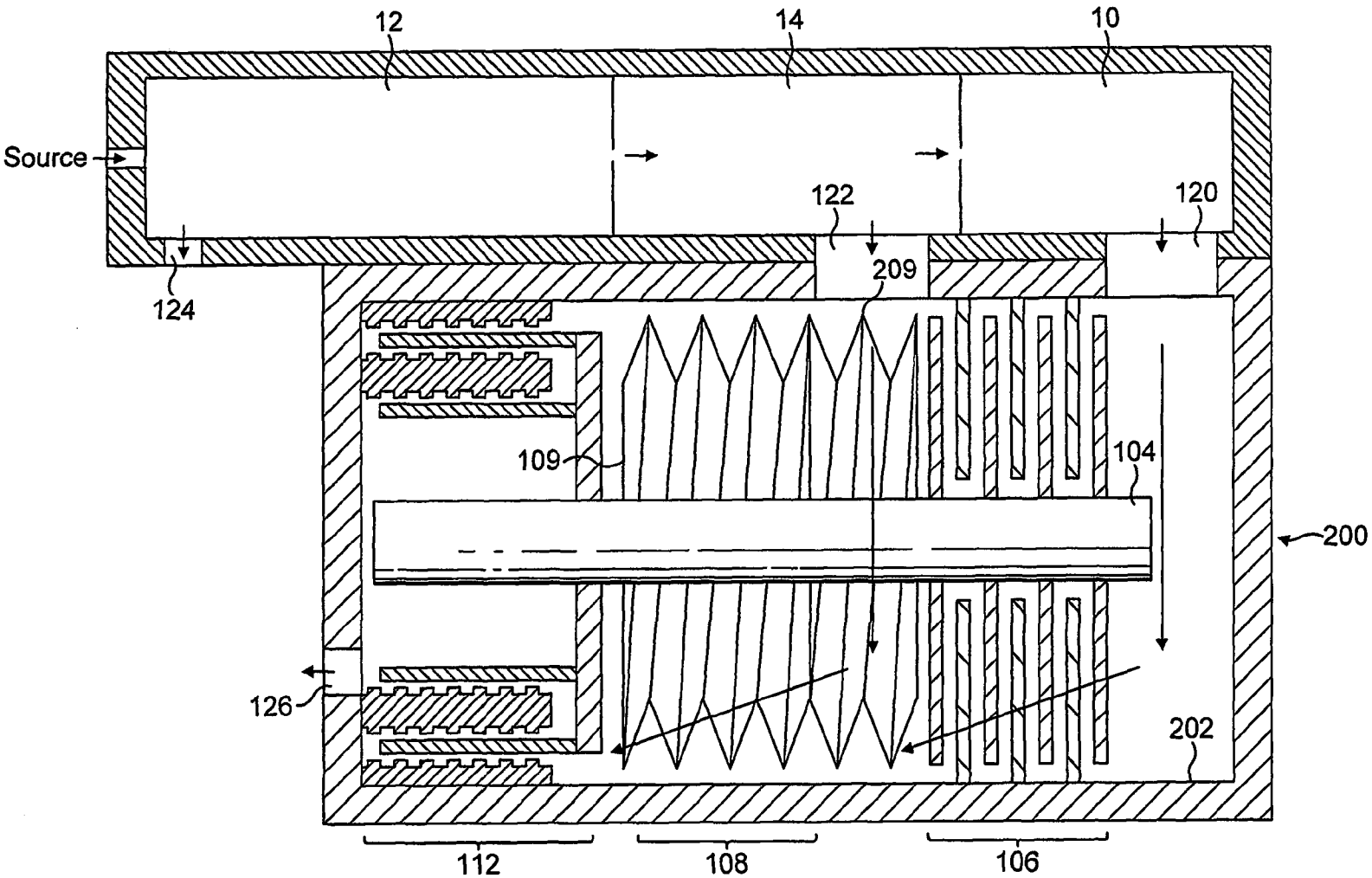
FIG. 4(*a*) is a simplified cross-section through a second embodiment of a multi port vacuum pump suitable for evacuating the differentially pumped mass spectrometer system of FIG. 1.
Figure 4B:
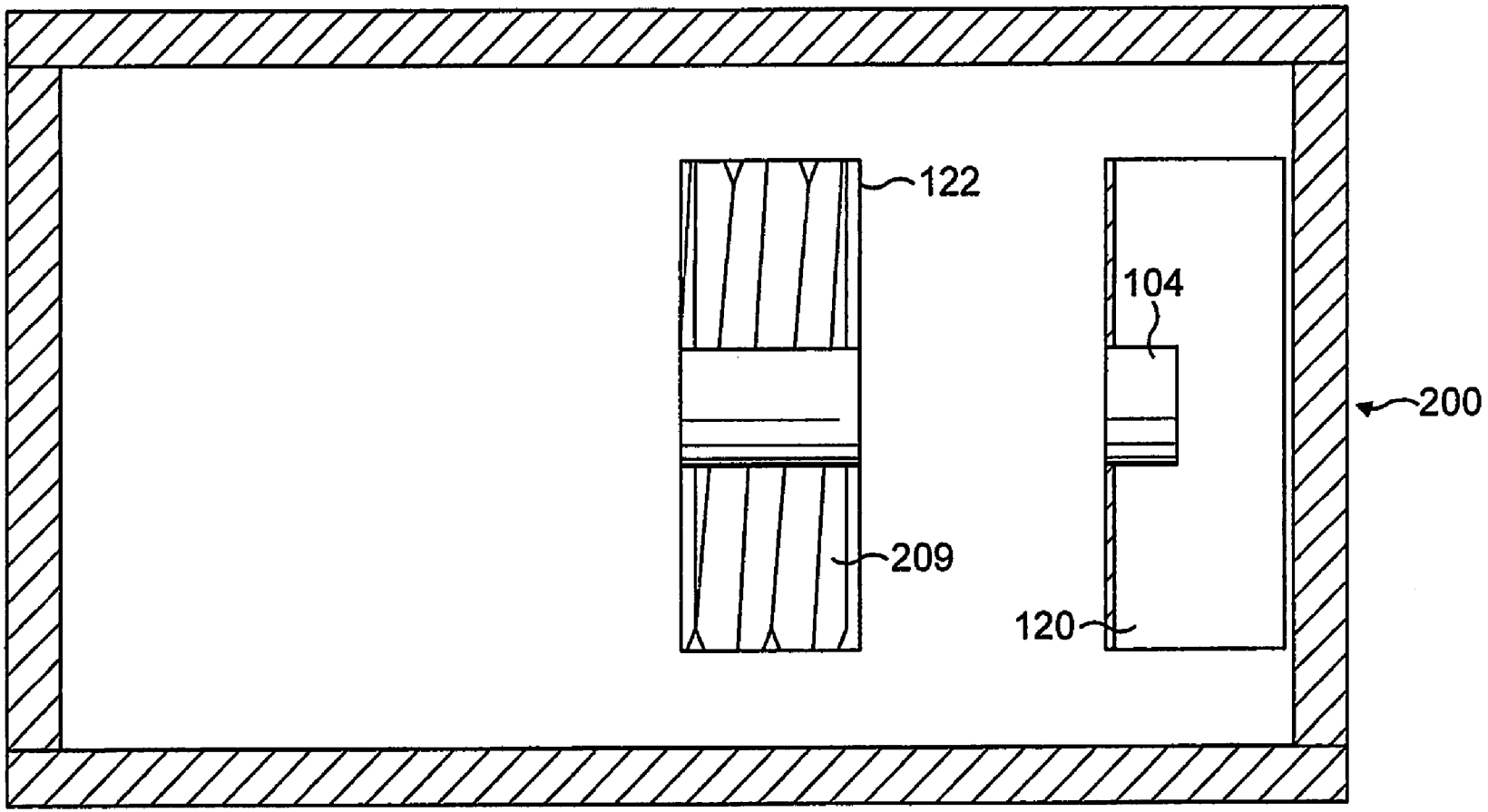
Figure 5:
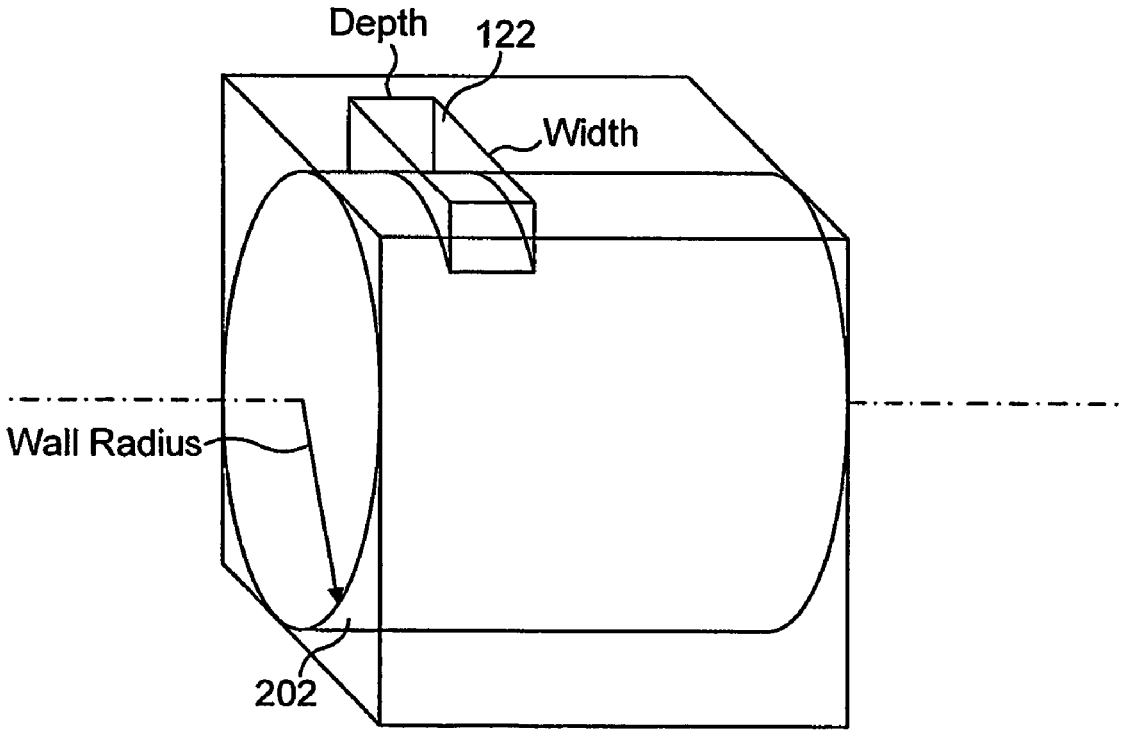
FIG. 5 illustrates the configuration of a pump inlet of the pump of FIG. 4(*a*)

FIGS. 4(*a*) and 4(*b*) illustrate a second embodiment of a vacuum pump 200 suitable for evacuating at the least the high vacuum chamber 10 and intermediate chamber 14 of the differentially pumped mass spectrometer system described above with reference to FIG. 1. The second embodiment is similar to the first embodiment, with the exception that the second pumping section 108 has been extended towards the first pumping section 106. This may be achieved by simply increasing the length of the second pumping section, as shown in FIG. 4(*a*) where the increase in length is indicated at 209, or by displacing the rotor 109 towards the first pumping section 106 As a result, rather than both of the first and second pumping sections 106, 108 being axially displaced relative to the first and second inlets 120, 122, as in the first embodiment, part of the second pumping section 108 is now axially adjacent the second inlet, such that the second inlet 122 now extends partially around the second pumping section 108. FIG. 5 illustrates schematically how at least the second inlet 122 extends partially around the cylindrical inner wall 202 of the body 102 of the pump 200. By circumferentially exposing part of the helical rotor 109 to the middle chamber 14 via the second inlet port 122, the capture rate of molecules from the chamber 14 can be improved in comparison to the first embodiment, thereby further lowering the pressure in the middle chamber 14 and further increasing the performance of the differentially pumped mass spectrometer system.

Figure 6A:
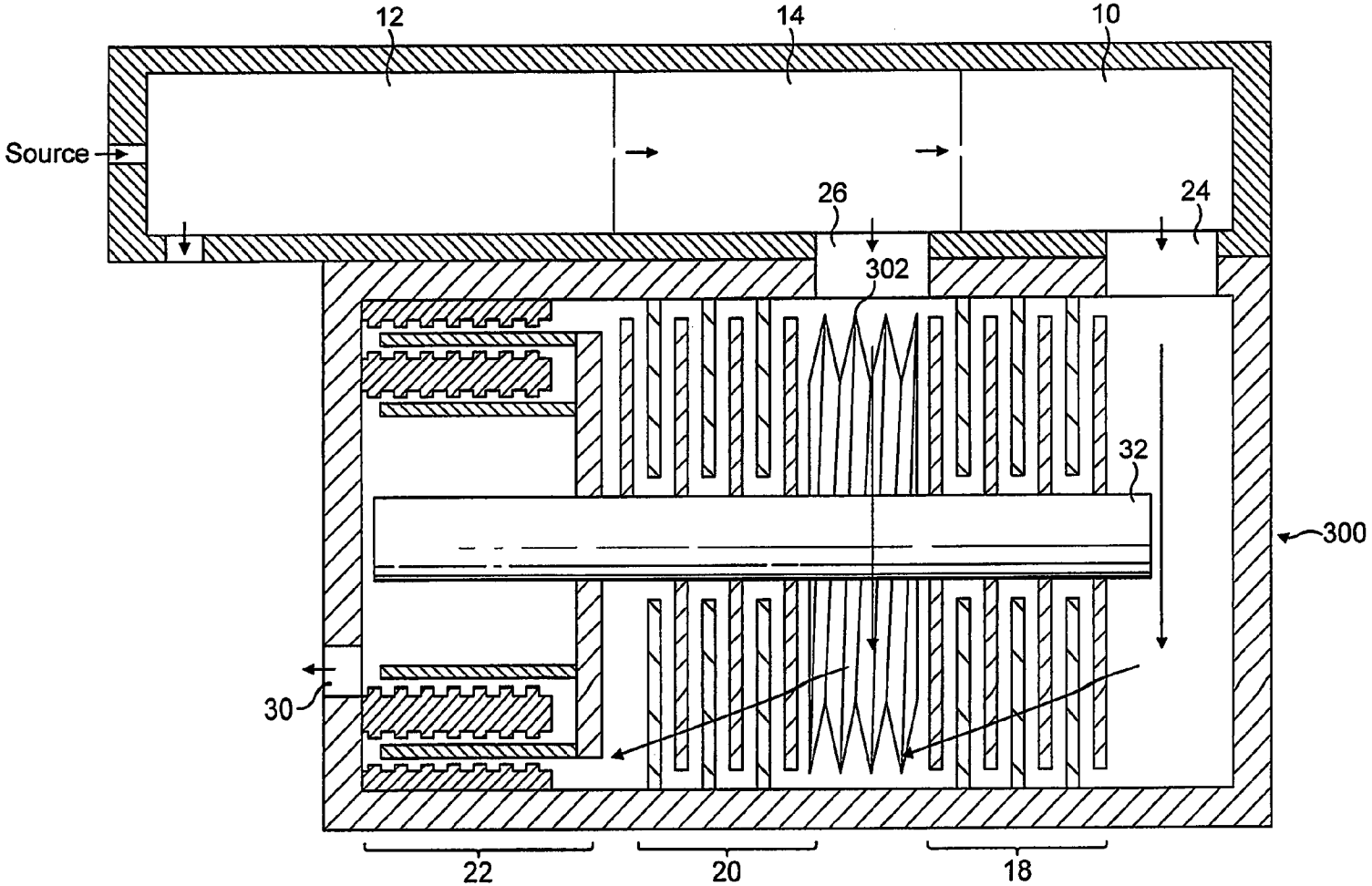
FIG. 6(*a*) is a simplified cross-section through a third embodiment of a multi port vacuum pump suitable for evacuating the differentially pumped mass spectrometer system of FIG. 1.
Figure 6B:
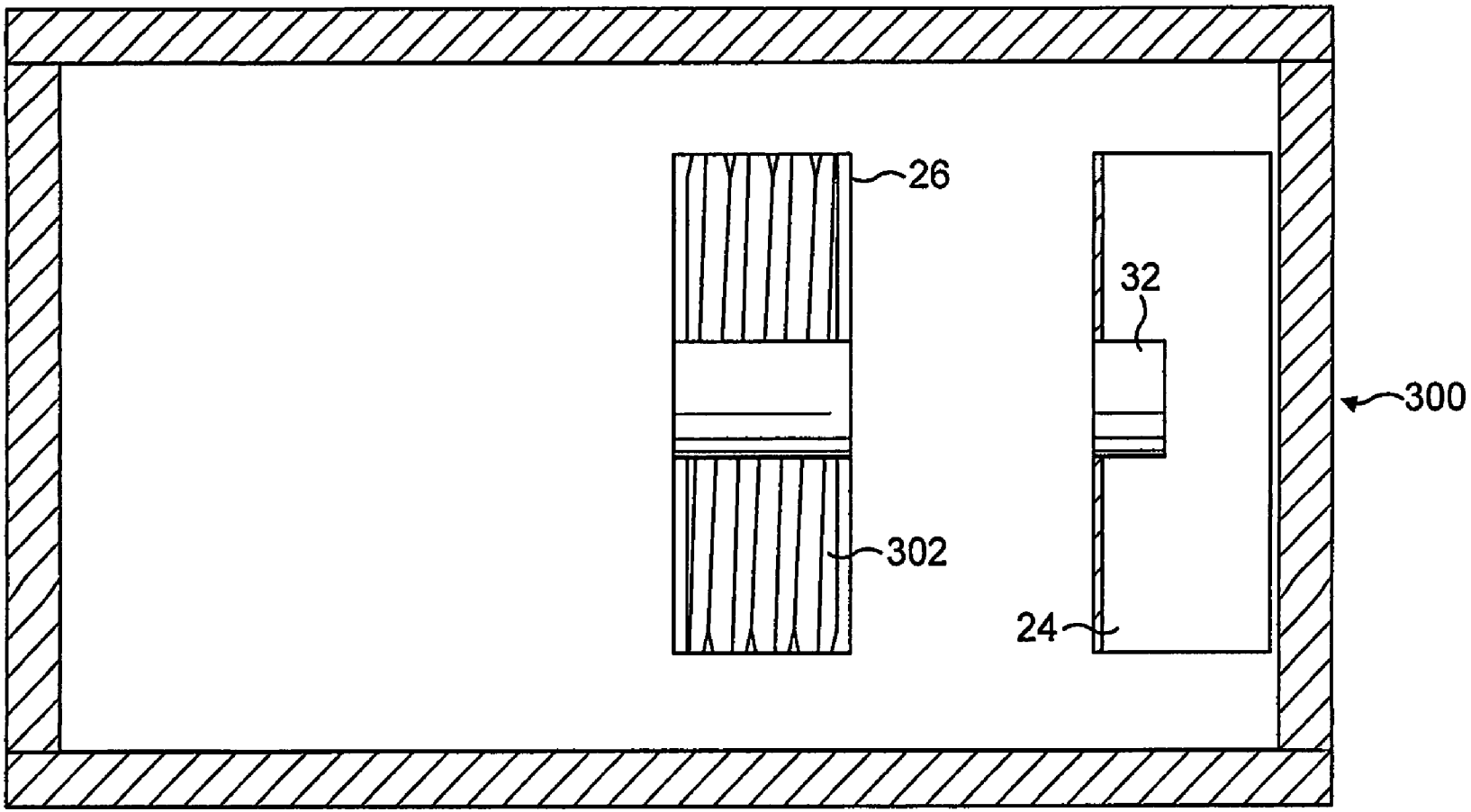

FIGS. 6(*a*) and 6(*b*) illustrate a third embodiment of a vacuum pump 300 suitable for evacuating at the least the high vacuum chamber 10 and intermediate chamber 14 of the differentially pumped mass spectrometer system described above with reference to FIG. 1. This third embodiment is similar to the prior art pump 16 shown in FIG. 1, with the exception that the second pumping section 20 now includes a helical rotor 302 located between the turbomolecular stages of the second pumping section 20 and the first pumping section 18. As in the second embodiment described above, part of the second pumping section 20 is now axially adjacent the second inlet 26, such that the second inlet 26 now extends partially around a helical rotor 302 of the second pumping section 20. Due to the circumferential exposure of part of the helical rotor 302 of the second pumping section 18 to the middle chamber 14, the capture rate of molecules from the middle chamber 14 can be increased in comparison to the prior art, thereby lowering the pressure in the middle chamber 14 and increasing the performance of the differentially pumped mass spectrometer system.

We claim:

1. A vacuum pump comprising a first pumping section, a second pumping section downstream from the first pumping section, a third pumping section downstream from the second pumping section, a first pump inlet through which fluid can enter the pump and pass through each of the pumping sections towards a pump outlet, and a second pump inlet through which fluid can enter the pump and pass through only the second and the third pumping sections towards the pump outlet, wherein the third pumping section comprises a helical groove formed in a stator thereof, the second pumping section comprises a helical groove formed in a rotor thereof, and the first and second pumping sections are sized substantially the same in a radial direction, such that the second pumping section that has the helical groove formed in the rotor thereof is able to increase a pumping capacity without a corresponding increase in size, wherein a depth of the helical groove on the rotor at an inlet side thereof is greater than a depth of the helical groove on the stator at an inlet side thereof.

2. The pump according to claim 1 wherein the depth of the helical groove on the rotor varies from the inlet side thereof to an outlet side thereof.

3. The pump according to claim 2 wherein the depth of the helical groove on the rotor decreases from the inlet side thereof to the outlet side thereof.

4. The pump according to claim 3 wherein an inclination of the helical groove on the rotor varies from the inlet side thereof to the outlet side thereof.

5. The pump according to claim 4 wherein the inclination of the helical groove on the rotor decreases from the inlet side thereof to the outlet side thereof.

6. The pump according to claim 5 wherein the second pumping section comprises said rotor.

7. The pump according to claim 6 wherein the first pumping section comprises at least one turbo-molecular stage.

8. The pump according to claim 7 wherein the turbo-molecular stage of the first pumping section is arranged such that, in use, molecules of fluid entering the helical groove on the rotor are emitted from the surface of a stator thereof.

9. The pump according to claim 8 wherein both the first and second pumping sections are axially displaced relative to the first and second inlets.

10. The pump according to claim 9 wherein one of the first and second inlets extends at least partially around the rotor.

11. The pump according to claim 7 wherein the first pumping section comprises at least three turbo-molecular stages.

12. The pump according to claim 1 wherein said one of the first and second pumping sections comprises at least one turbo-molecular stage downstream from said rotor.

13. The pump according to claim 1 wherein the depth of the helical groove on the rotor decreases from the inlet side thereof to an outlet side thereof.

14. The pump according to claim 1 wherein an inclination of the helical groove on the rotor varies from the inlet side thereof to an outlet side thereof.

15. The pump according to claim 1 wherein an inclination of the helical groove on the rotor decreases from the inlet side thereof to an outlet side thereof.

16. The pump according to claim 1, wherein the first pumping section comprises at least one turbo-molecular stage.

17. The pump according to claim 16 wherein the turbo-molecular stage of the first pumping section is arranged such that, in use, molecules of fluid entering the helical groove on the rotor are emitted from the surface of a stator thereof.

18. The pump according to claim 17 wherein the first pumping section comprises at least three turbo-molecular stages.

19. The pump according to claim 18 wherein both the first and second pumping sections are axially displaced relative to the first and second inlets.

20. The pump according to claim 19 wherein one of the first and second inlets extends at least partially around the rotor.

21. The pump according to claim 1 wherein both the first and second pumping sections are axially displaced relative to the first and second inlets.

22. The pump according to claim 1 wherein one of the first and second inlets extends at least partially around the rotor.

23. A differentially pumped vacuum system comprising two chambers and further comprising a pump according to claim 1 for evacuating each of the chambers.

24. A vacuum pump comprising a first pumping section and, downstream therefrom, a second pumping section, a first pump inlet through which fluid can enter the pump and pass through both the first pumping section and the second pumping section towards a pump outlet, and a second pump inlet through which fluid can enter the pump and pass through, of said sections, only the second pumping section towards the pump outlet, wherein the second pumping section comprises an externally threaded rotor and at least one turbo-molecular stage downstream from the externally threaded rotor, the second pump inlet extends at least partially about the externally threaded rotor, and the first and second pumping sections are sized substantially the same in a radial direction, such that the second pumping section that has the externally threaded rotor is able to increase a pumping capacity without a corresponding increase in size.

25. The pump according to claim 24 wherein the externally threaded rotor comprises a helical groove.

26. The pump according to claim 25 wherein a depth of the helical groove varies from an inlet side thereof to an outlet side thereof.

27. The pump according to claim 26 wherein the depth of the helical groove decreases from the inlet side thereof to the outlet side thereof.

28. The pump according to claim 27 wherein an inclination of the groove varies from the inlet side thereof to the outlet side thereof.

29. The pump according to claim 28 wherein the inclination of the groove decreases from the inlet side thereof to the outlet side thereof.

30. The pump according to claim 25 comprising at least one additional pumping section downstream from the first and second pumping sections for receiving fluid therefrom and outputting fluid towards the outlet.

31. The pump according to claim 30 wherein said at least one additional pumping section comprises a molecular drag stage.

32. The pump according to claim 24 wherein the first pumping section comprises at least one turbo-molecular stage.

33. The pump according to claim 32 wherein the first pumping section comprises at least three turbo-molecular stages.

34. The pump according to claim 33 wherein the turbo-molecular stage of the first pumping section is arranged such that, in use, molecules of fluid entering the external thread therefrom are emitted from the surface of a stator thereof.

35. The pump according to claim 34 comprising at least one additional pumping section downstream from the first and second pumping sections for receiving fluid therefrom and outputting fluid towards the outlet.

36. The pump according to claim 35 wherein said at least one additional pumping section comprises a molecular drag stage.

37. The pump according to claim 32 comprising at least one additional pumping section downstream from the first and second pumping sections for receiving fluid therefrom and outputting fluid towards the outlet.

38. A differentially pumped vacuum system comprising two chambers and further comprising a pump according to claim 24 for evacuating each of the chambers.

39. The system according to claim 38 wherein one of the pumping sections arranged to pump fluid from a chamber in which a pressure of above $10^{-3}$ mbar is to be generated comprises an externally threaded rotor.

40. The system according to claim 39 wherein at least one of the pumping stages arranged to pump fluid from a chamber in which a pressure of above $5\times10^{-3}$ mbar is to be generated comprises an externally threaded rotor.

41. The system according to claim 38 wherein at least one of the pumping stages arranged to pump fluid from a chamber in which a pressure of above $5\times10^{-3}$ mbar is to be generated comprises an externally threaded rotor.

42. The pump according to claim 24 wherein the first pumping section comprises at least one turbo-molecular stage.

43. The pump according to claim 42 wherein the turbo-molecular stage is arranged such that, in use, molecules of fluid entering the external thread therefrom are emitted from the surface of a stator thereof.

44. The pump according to claim 43 comprising at least one additional pumping section downstream from the first and second pumping sections for receiving fluid therefrom and outputting fluid towards the outlet.

45. The pump according to claim 24 comprising at least one additional pumping section downstream from the first and second pumping sections for receiving fluid therefrom and outputting fluid towards the outlet.

* * * * *